US011248364B2

(12) United States Patent
Morikawa et al.

(10) Patent No.: US 11,248,364 B2
(45) Date of Patent: Feb. 15, 2022

(54) WORK MACHINE

(71) Applicant: Hitachi Construction Machinery Co., Ltd., Tokyo (JP)

(72) Inventors: Masatoshi Morikawa, Tsukuba (JP); Shinya Imura, Toride (JP); Shinji Nishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 795 days.

(21) Appl. No.: 15/998,937

(22) PCT Filed: Feb. 24, 2017

(86) PCT No.: PCT/JP2017/007242
§ 371 (c)(1),
(2) Date: Aug. 17, 2018

(87) PCT Pub. No.: WO2018/051533
PCT Pub. Date: Mar. 22, 2018

(65) Prior Publication Data

US 2021/0207342 A1 Jul. 8, 2021

(30) Foreign Application Priority Data

Sep. 16, 2016 (JP) ..... JP2016-182200

(51) Int. Cl.
*E02F 9/12* (2006.01)
*E02F 9/20* (2006.01)
(Continued)

(52) U.S. Cl.
CPC ..... *E02F 9/123* (2013.01); *E02F 9/2004* (2013.01); *E02F 9/2235* (2013.01);
(Continued)

(58) Field of Classification Search
CPC ..... E02F 9/123; E02F 9/2235; E02F 9/2296; E02F 9/2004
See application file for complete search history.

(56) References Cited

U.S. PATENT DOCUMENTS 5,056,312 A 10/1991 Hirata et al.
6,981,311 B2 * 1/2006 Seith ..... B25B 21/00 29/407.01
(Continued)

FOREIGN PATENT DOCUMENTS

JP 63-75223 A 4/1988
JP 9-144070 A 6/1997
(Continued)

OTHER PUBLICATIONS

International Search Report (PCT/ISA/210) issued in PCT Application No. PCT/JP2017/007242 dated Apr. 4, 2017 with English translation (five pages).
(Continued)

*Primary Examiner* — Abiy Teka
(74) *Attorney, Agent, or Firm* — Crowell & Moring LLP

(57) ABSTRACT

To control a rate of increase of a delivery flow rate of a pump for a swing operation in response to a moment of inertia and an operation amount and to achieve both energy efficiency and operability with respect to the swing operation, a work machine including a swing structure 2 disposed on an upper portion of a track structure 1, a work implement 3 disposed in the swing structure 2, a swing motor 16, a hydraulic pump 22, a regulator 24, a directional control valve 31, and an operation device 34 further includes: a target maximum flow rate calculation section 53 configured to calculate a target maximum flow rate Qmax of the pump to correspond to a swing operation amount Ps; a flow rate rate-of-increase calculation section 55 configured to calculate a rate of increase dQ of a command flow rate of the hydraulic pump
(Continued)

22 on a basis of the moments of inertia of the swing structure 2 and the work implement 3 and the swing operation amount Ps; a command flow rate calculation section 56 configured to calculate a command flow rate Q(t) on a basis of the rate of increase dQ with the target maximum flow rate Qmax set as an upper limit; and an output section 57 configured to output a command signal Sf to the regulator 24 corresponding to the command flow rate Q(t).

7 Claims, 10 Drawing Sheets

(51) Int. Cl.
*E02F 9/22* (2006.01)
*E02F 3/32* (2006.01)

(52) U.S. Cl.
CPC ..... *E02F 9/2296* (2013.01); *E02F 3/32* (2013.01); *E02F 9/2285* (2013.01); *E02F 9/2292* (2013.01); *F15B 2211/20546* (2013.01); *F15B 2211/6652* (2013.01); *F15B 2211/6654* (2013.01); *F15B 2211/7058* (2013.01)

(56) References Cited

U.S. PATENT DOCUMENTS 9,309,645 B2 * 4/2016 Yamamoto ..... F04B 49/06
10,508,415 B2 * 12/2019 Kim ..... E02F 9/2267
2012/0131913 A1 * 5/2012 Yoshino ..... E02F 9/2235 60/459
2012/0285157 A1 * 11/2012 Okano ..... E02F 9/2235 60/445
2013/0125537 A1 5/2013 Kim

FOREIGN PATENT DOCUMENTS

JP 11-36376 A 2/1999
JP 11-37108 A 2/1999
JP 2986510 B2 12/1999
JP 2005-16228 A 1/2005
JP 2013-532782 A 8/2013
KR 10 2013 0124163 A 11/2013
WO WO 90/00683 A1 1/1990

OTHER PUBLICATIONS

Japanese-language Written Opinion (PCT/ISA/237) issued in PCT Application No. PCT/JP2017/007242 dated Apr. 4, 2017 (three pages).
Korean-language Office Action issued in counterpart Korean Application No. 10-2018-7024594 dated Sep. 30, 2019 with English translation (12 pages).
International Preliminary Report on Patentability (PCT/IB/338 & PCT/IB/373) issued in PCT Application No. PCT/JP2017/007242 dated Mar. 28, 2019, including English translation of document C2 (Japanese-language Written Opinion (PCT/ISA/237) previously filed on Oct. 8, 2018) (six (6) pages).
Extended European Search Report issued in European Application No. 17850443.7 dated Jun. 19, 2020 (four (4) pages).

* cited by examiner

WORK MACHINE

TECHNICAL FIELD

The present invention relates generally to work machines such as hydraulic excavators and, more particularly, to a work machine that performs pump flow control (capacity control) for a swing operation.

BACKGROUND ART

A known work machine such as a hydraulic excavator is configured such that a swing structure swings with respect to a base structure such as a track structure. Various types of equipment, including a work implement, a prime mover, a hydraulic pump, tanks, heat exchangers, electrical devices, and a cab are mounted on the swing structure. The work machine additionally bears weight of a load, such as a large amount of excavated earth and sand. The foregoing results in a large moment of inertia of the swing structure including the work implement and the load. As a result, delivery pressure of the hydraulic pump increases, for example, at the start of a swing operation and part of hydraulic fluid may be discharged via a relief valve to a hydraulic fluid tank, resulting in flow rate loss. To solve this problem, a technique is disclosed in which, to control a delivery flow rate of the pump with respect to the swing operation, a rate of increase in the delivery flow rate is limited according to the moment of inertia of the swing structure, to thereby reduce the flow rate of the hydraulic fluid discharged via the relief valve (see, for example, Patent Document 1).

PRIOR ART DOCUMENT

Patent Document

Patent Document 1: JP-2013-532782-T

SUMMARY OF THE INVENTION

Problem to be Solved by the Invention

With the technique disclosed in Patent Document 1, however, the rate of increase in the delivery flow rate is limited depending only on the moment of inertia, so that the rate of increase may remain constant under a condition of an identical moment of inertia regardless of an operation amount. Specifically, the technique disclosed in Patent Document 1 causes the rate of increase in the delivery flow rate to decrease with a moment of inertia greater than a predetermined value and to increase with a moment of inertia smaller than the predetermined value. Thus, when the moment of inertia of the swing structure is small, for example, swing angular acceleration may be large against the intention of an operator even when the operator minimally performs a lever operation to achieve a slow and careful swing motion because the delivery flow rate depends on the moment of inertia regardless of the operation amount.

An object of the present invention is to provide a work machine that varies the rate of increase in the delivery flow rate of a pump acting on a swing operation according to the moment of inertia and the operation amount, to thereby be able to achieve both energy efficiency and operability with respect to the swing operation.

Means for Solving the Problem

To achieve the foregoing object, an aspect of the present invention provides a work machine including a base structure, a swing structure disposed swingably on an upper portion of the base structure, a work implement disposed in the swing structure, a swing motor that drives the swing structure, a variable displacement type hydraulic pump that delivers hydraulic fluid for driving the swing motor, a regulator configured to regulate a delivery flow rate of the hydraulic pump, a directional control valve configured to control hydraulic fluid to be supplied from the hydraulic pump to the swing motor, and an operation device configured to generate an operation signal corresponding to an operation and drive the directional control valve. The work machine provided by the aspect of the present invention includes: an operation amount sensor configured to detect a swing operation amount as an operation amount of the operation device; a plurality of state quantity sensors configured to detect state quantities serving as bases for calculation of moments of inertia of the swing structure and the work implement; a target maximum flow rate calculation section configured to calculate a target maximum flow rate of the hydraulic pump to correspond to the swing operation amount; a moment-of-inertia calculation section configured to calculate the moments of inertia on a basis of the state quantities detected by the state quantity sensors; a flow rate rate-of-increase calculation section configured to calculate, in accordance with a relation established in advance among the moments of inertia, the swing operation amount, and a rate of increase of a command flow rate with respect to the hydraulic pump, the rate of increase on a basis of the moments of inertia calculated by the moment-of-inertia calculation section and the swing operation amount detected by the operation amount sensor; a command flow rate calculation section configured to calculate the command flow rate on a basis of the rate of increase calculated by the flow rate rate-of-increase calculation section with the target maximum flow rate calculated by the target maximum flow rate calculation section set as an upper limit; and an output section configured to output a command signal to the regulator corresponding to the command flow rate calculated by the command flow rate calculation section.

Effect of the Invention

The aspect of the present invention can achieve both energy efficiency and operability with respect to the swing operation by varying the rate of increase in the delivery flow rate of the pump acting on the swing operation according to the moment of inertia and the operation amount.

MODES FOR CARRYING OUT THE INVENTION

Embodiments of the present invention will be described below with reference to the accompanying drawings.

First Embodiment (1-1) Work Machine

Figure 1:
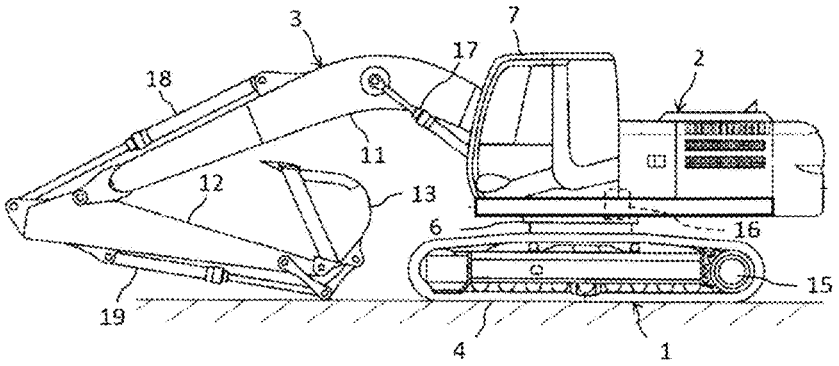
FIG. 1 is a perspective view of an appearance of a hydraulic excavator as an exemplary work machine according to an embodiment of the present invention.

FIG. 1 is a perspective view of an appearance of a hydraulic excavator as an exemplary work machine according to each of embodiments of the present invention. Unless otherwise specified in the following, the direction forward of a driver's seat (the leftward direction in FIG. 1) is forward with respect to the machine. It should, however, be noted that the present invention can be applied to, not only the hydraulic excavator exemplified in the embodiments, but also other types of work machines, including a crane, provided with a swing structure that swings with respect to a base structure.

The hydraulic excavator shown in FIG. 1 includes a track structure 1, a swing structure 2 disposed on the track structure 1, and a work implement (front work implement) 3 mounted on the swing structure 2. The track structure 1 constitutes a base structure for the work machine and is a crawler type track structure traveling with left and right crawler belts 4. A stationary work machine may include, for example, a post fixed to the ground as a base structure to serve in place of the track structure. The swing structure 2 is disposed on an upper portion of the track structure 1 via a swing wheel 6. The swing structure 2 includes a cab 7 at a front portion on the left side. A seat (not shown) in which an operator sits and operation devices (e.g., operation devices 34 and 35 shown in FIG. 2) to be operated by the operator are disposed inside the cab 7. The work implement 3 includes a boom 11, an arm 12, and a bucket 13. The boom 11 is rotatably mounted at a front portion of the swing structure 2. The arm 12 is rotatably coupled with a distal end of the boom 11. The bucket 13 is rotatably coupled with a distal end of the arm 12.

The hydraulic excavator includes, as hydraulic actuators, left and right track motors 15, a swing motor 16, a boom cylinder 17, an arm cylinder 18, and a bucket cylinder 19. The left and right track motors 15 drive the respective left and right crawler belts 4 of the track structure 1. The swing motor 16 drives the swing wheel 6 to thereby drive to swing the swing structure 2 with respect to the track structure 1. The boom cylinder 17 drives the boom 11 up and down. The arm cylinder 18 drives the arm 12 toward a dump side (open side) and toward the crowd side (scoop side). The bucket cylinder 19 drives the bucket 13 toward the dump side and the crowd side.

(1-2) Hydraulic System

Figure 2:
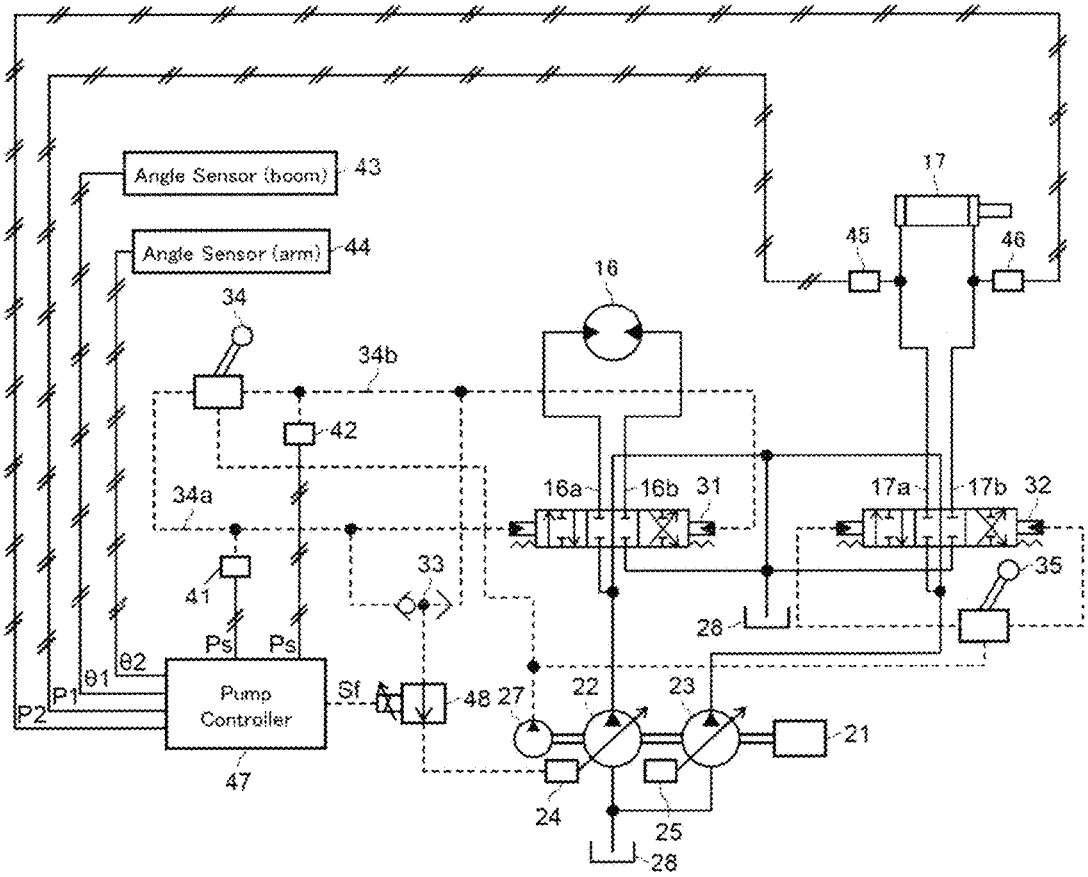
FIG. 2 is a circuit diagram showing major components of a hydraulic system included in the work machine according to a first embodiment of the present invention.

FIG. 2 is a circuit diagram showing major components of a hydraulic system included in the work machine according to the first embodiment of the present invention. The work machine shown in FIG. 1 includes an engine 21, hydraulic pumps 22 and 23, regulators 24 and 25, a pilot pump 27, a tank 28, directional control valves 31 and 32, a shuttle valve 33, and the operation devices 34 and 35. The work machine further includes operation amount sensors 41 and 42, angle sensors 43 and 44, pressure sensors 45 and 46, and a pump controller 47.

(1-2. 1) Engine

The engine 21 is a prime mover. The engine 21 is an internal combustion engine, such as a diesel engine, having an output shaft coaxially coupled with the hydraulic pumps 22 and 23 and the pilot pump 27, thereby driving the hydraulic pumps 22 and 23 and the pilot pump 27. A speed of the engine 21 is set by an engine controller dial (not shown) and controlled by an engine controller (not shown). Although the present embodiment exemplarily uses the engine 21 for the prime mover, an electric motor or an electric motor and an internal combustion engine may be used ac the prime mover.

(1-2. 2 Pumps)

The hydraulic pumps 22 and 23 are each a variable displacement type, drawing hydraulic operating fluid stored in the tank 28 and delivering the hydraulic operating fluid as hydraulic fluid that drives the hydraulic actuators including the swing motor 16 and the boom cylinder 17. Relief valves are disposed, though not shown in FIG. 2, in delivery lines of the hydraulic pumps 22 and 23. The relief valves specify maximum pressure of the delivery lines. The pilot pump 27 is a fixed displacement type, outputting source pressure for operation signals (hydraulic signals) generated by, for example, the hydraulic pilot type operation devices 34 and 35. The pilot pump 27, though driven by the engine 21 in the present embodiment, may be driven by, for example, a separately provided motor (not shown).

It is noted that, for the present embodiment, a circuit configuration is illustrated in which the hydraulic pump 22 supplies hydraulic fluid to the swing motor 16 only out of the hydraulic actuators. A configuration is nonetheless possible in which the hydraulic fluid delivered by the hydraulic pump 22 is to be supplied to other hydraulic actuators. In this case, however, the hydraulic circuit configuration is such that, when a swing operation is performed, the hydraulic fluid is supplied to the swing motor 16 from a specific hydraulic pump and, as long as the hydraulic fluid is supplied to the swing motor 16, no other hydraulic actuators receive hydraulic fluid from that particular hydraulic pump. This arrangement can be achieved, for example, by providing a control valve (not shown) configured to control a connection relation between the delivery lines of the hydraulic pumps 22 and 23 and actuator lines of the respective hydraulic actuators and controlling the control valve using a swing operation signal.

(1-2. 3) Regulators

The regulators 24 and 25 regulate delivery flow rates of the respective hydraulic pumps 22 and 23. The regulators 24 and 25 are provided with a servo piston (not shown) and a solenoid valve 48 coupled with variable displacement mechanisms of the respective hydraulic pumps 22 and 23. The solenoid valve 48 is a proportional solenoid valve. The solenoid valve 48 is driven by a command signal of the pump controller 47 and outputs a flow rate command signal that is generated through reduction of pressure of an operation signal of the operation device 34 for a swing operation to the servo piston or a control valve (not shown) configured to control the servo piston, to thereby vary the delivery flow rate of the hydraulic pump 22. It is noted that the source pressure for the flow rate command signal to be output by the solenoid valve 48 is not limited only to the operation signal of the operation device 34 and may, for example, be delivery pressure of the pilot pump 27.

(1-2. 4) Directional Control Valves

The directional control valves 31 and 32 are control valves for varying directions and flow rates of hydraulic fluid supplied to the hydraulic actuators, such as the swing motor 16 and the boom cylinder 17, from the respective hydraulic pumps 22 and 23. The directional control valves 31 and 32 are disposed in the delivery lines of the respective hydraulic pumps 22 and 23. Although FIG. 2 shows only the directional control valves 31 and 32 associated with the respective swing motor 16 and boom cylinder 17, directional control valves associated with other hydraulic actuators including the arm cylinder 18 also exist. The directional control valves 31 and 32 in the present embodiment each include a center bypass and, at a central neutral position, allow all of the hydraulic fluid delivered from the hydraulic pumps 22 and 23 to return to the tank 28. For example, when spools of the directional control valves 31 and 32 move to the right in FIG. 2, the rate of hydraulic fluid supplied to actuator lines 16*a* and 17*a* out of the hydraulic fluid delivered by the hydraulic pumps 22 and 23 increases, so that the swing motor 16 rotates in one direction and the boom cylinder 17 extends. When the spools move to the left, the rate of hydraulic fluid supplied to actuator lines 16*b* and 17*b* increases, so that the swing motor 16 rotates in the other direction and the boom cylinder 17 contracts.

(1-2. 5) Operation Devices

The operation devices 34 and 35 generate operation signals directing operations of the swing motor 16 and the boom cylinder 17, respectively. In the present embodiment, the operation devices 34 and 35 are hydraulic pilot type lever operation devices. The operation devices 34 and 35 are configured such that a pressure reducing valve is operated by an operation lever. Although FIG. 2 shows only the operation device 34 for a swing operation and the operation device 35 for a boom operation, operation devices directing operations of other hydraulic actuators including the arm cylinder 18 also exist separately. With the operation device 34 for the swing operation, for example, when the operation lever is inclined and placed toward one side, the delivery pressure of the pilot pump 27 is reduced to correspond to an operation amount and an operation signal generated thereby is output to a signal line 34*a*. When the operation lever is inclined and placed toward the other side, an operation signal of pressure corresponding to the operation amount is output to a signal line 34*b*. The operation signal output from the operation device 34 is input to a pilot pressure receiving part corresponding to the directional control valve 31 via the signal line 34*a* or 34*b*. This drives the directional control valve 31, so that the swing motor 16 operates to correspond to the operation.

(1-2. 6) Shuttle Valve

The shuttle valve 33 is, for example, a high-pressure selector valve disposed in the signal lines 34*a* and 34*b* of the operation device for the swing operation (strictly, signal lines branched from the signal lines 34*a* and 34*b*). The shuttle valve 33 selects either a signal line lib or a signal line 11*c*, whichever is higher in pressure (operation signal), and outputs the signal to the solenoid valve 48. Thus, when the operation lever of the operation device 34 is placed in either one direction, the operation signal generated by the lever operation is output via the shuttle valve 33 to the solenoid valve 48 as source pressure for the flow rate command signal.

(1-2. 7) Sensors

The operation amount sensors 41 and 42 detect the operation amount of the operation device 34 for the swing operation (swing operation amount) and are pressure sensors in the present embodiment. The operation amount sensors 41 and 42 detect pressure of the signal lines 34*a* and 34*b*, respectively, of the operation device 34 (swing operation amount Ps). It is noted that the operation amount sensors 41 and 42 may each be, instead of the pressure sensor, an angle sensor configured to detect an angle of the operation lever or any other type of sensor.

The angle sensors 43 and 44 and the pressure sensors 45 and 46 are state quantity sensors configured to detect different state quantities that serve as bases for calculating moments of inertia of rotating bodies (the swing structure 2 and elements that rotate with the swing structure 2 with respect to the track structure 1) composed of the swing structure 2, the work implement 3, and a load of the work implement 3. The moment of inertia varies with posture and weight of the rotating body. The angle sensors 43 and 44 detect information for calculating the posture of the work implement 3. The pressure sensors 45 and 46 detect information for calculating the weight of the rotating body (including the weight of the load, such as sand, scooped by the bucket 13). Specifically, the angle sensor 43 detects an angle 81 formed between the swing structure 2 and the boom 11. The angle sensor 44 detects an angle θ2 formed between the boom 11 and the arm 12. The pressure sensors 45 and 46 detect load pressure of the boom cylinder 17. Specifically, the pressure sensor 45 detects bottom pressure P1 of the boom cylinder 17 and the pressure sensor 46 detects rod pressure P2 of the boom cylinder 17. Although the present embodiment uses the two pressure sensors 45 and 46 to detect differential pressure across the boom cylinder 17, a differential pressure gauge may instead be used. A still another possible configuration is such that a single pressure sensor detects pressure of a fluid chamber or an actuator line that bears the weight of the boom (in the present embodiment, a bottom-side fluid chamber or an actuator line connected with the bottom-side fluid chamber).

Detection signals of the operation amount sensors 41 and 42, the angle sensors 43 and 44, and the pressure sensors 45 and 46 are output to the pump controller 47.

(1-2. 8) Pump Controller

Figure 3:
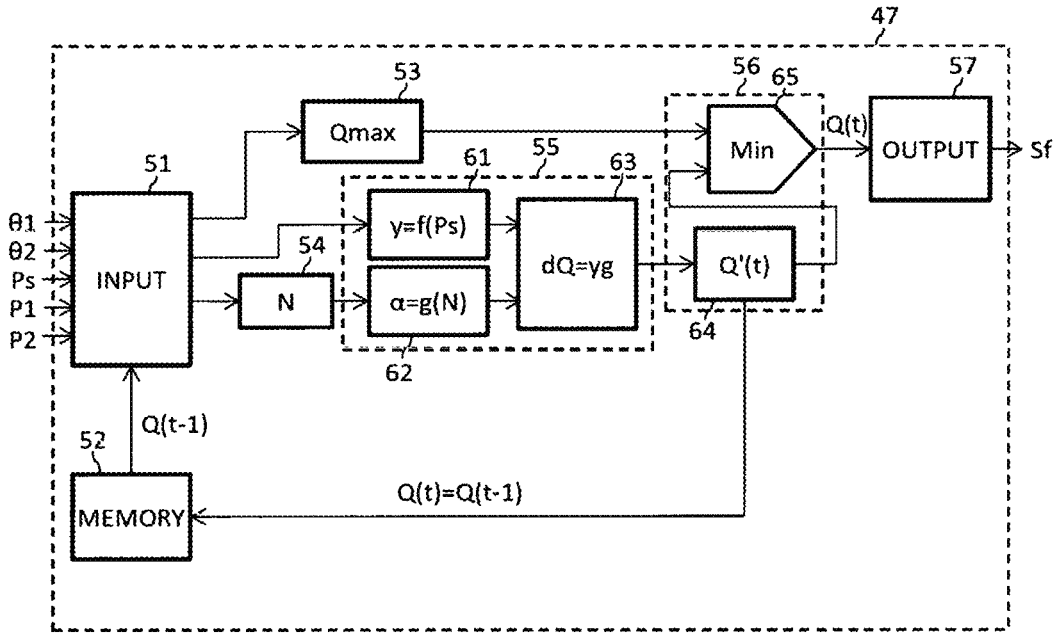
FIG. 3 is a schematic diagram of a pump controller included in the work machine according to the first embodiment of the present invention.

FIG. 3 is a schematic diagram of the pump controller in the present embodiment. The pump controller 47 receives inputs of the detection signals of the operation amount sensors 41 and 42, the angle sensors 43 and 44, and the pressure sensors 45 and 46 and, using the foregoing signals, outputs a command signal Sf to the regulator 24 (solenoid valve 48) to thereby vary the delivery flow rate of the hydraulic pump 22. The pump controller 47 is included in a machine controller (not shown) configured to control general operations of the work machine.

The pump controller 47 includes an input section 51, a storage section 52, a target maximum flow rate calculation section 53, a moment-of-inertia calculation section 54, a flow rate rate-of-increase calculation section 55, a command flow rate calculation section 56, and an output section 57.

Input Section

The input section 51 receives inputs of the swing operation amount Ps as the detection signal of the operation amount sensor 41 or 42, the angles θ1 and θ2 as the detection signals of the angle sensors 43 and 44, and the pressures P1 and P2 as the detection signals of the pressure sensors 45 and 46.

Storage Section

The storage section 52 stores, for example, information including control tables required for calculating and outputting the command signal Sf for the solenoid valve 48, a program, and calculation results.

Target Maximum Flow Rate Calculation Section

The target maximum flow rate calculation section 53 is a processing section configured to calculate a target maximum flow rate Qmax of the swing motor 16 to correspond to the swing operation amount Ps detected by the operation amount sensor 41 or 42. A relation has previously been established between the swing operation amount Ps and the target maximum flow rate Qmax such that, for example, the target maximum flow rate Qmax monotonously increases with an increase in the swing operation amount Ps. The storage section 52 stores a control table that defines the foregoing relation. The target maximum flow rate calculation section 53 reads a corresponding control table from the storage section 52, calculates the target maximum flow rate Qmax corresponding to the swing operation amount Ps on the basis of the control table, and outputs the target maximum flow rate Qmax to the command flow rate calculation section 56. The target maximum flow rate Qmax represents a maximum value of the delivery flow rate to be output by the hydraulic pump 22 to correspond to the swing operation amount Ps. In the present embodiment, the pump delivery flow rate increases at a predetermined rate of increase up to the target maximum flow rate Qmax as an upper limit.

Moment-of-Inertia Calculation Section

The moment-of-inertia calculation section 54 is a processing section configured to calculate a moment of inertia N on the basis of the state quantities (the angles θ1 and θ2 and the pressure P1 and P2) detected by the angle sensors 43 and 44 and the pressure sensors 45 and 46. The moment-of-inertia calculation section 54 uses the angles θ1 and θ2 detected by the angle sensors 43 and 44 to calculate posture of the work implement 3 and uses the pressure P1 and P2 detected by the pressure sensors 45 and 46 to obtain weight of a load of the bucket 13 (or weight of a rotating body). The moment-of-inertia calculation section 54 calculates the moment of inertia N of the rotating body on the basis of the posture of the work implement 3 and the weight of the rotating body including the load of the bucket 13.

Flow Rate Rate-of-Increase Calculation Section

The flow rate rate-of-increase calculation section 55 calculates a rate of increase dQ of a command flow rate of the hydraulic pump 22 (command flow rate directed to the hydraulic pump 22) on the basis of the moment of inertia N calculated by the moment-of-inertia calculation section 54 and the swing operation amount Ps detected by the operation amount sensor 41 or 42. The rate of increase dQ represents an amount of increase per unit time of a target flow rate Q'(t) of the hydraulic pump 22. A command flow rate Q(t) directed to the hydraulic pump 22 is updated through repeated performance of predetermined steps at predetermined cycles (e.g., 0.1 seconds) in the present embodiment, as will be described later. Thus, dQ may be said to be an amount of increase per cycle time. The command flow rate Q(t) is a delivery flow rate (command value) of the hydraulic pump 22 commanded by the pump controller 47 at each processing cycle (to be described later) and increases for each cycle to the extent below the target maximum flow rate Qmax even when the swing operation amount Ps is not changed. Additionally, a relation among the moment of inertia N, the swing operation amount Ps, and the rate of increase dQ is established in advance and the storage section 52 stores a control table that defines the relation. The flow rate rate-of-increase calculation section 55 loads the applicable control table from the storage section 52 and calculates the rate of increase dQ using the moment of inertia N and the swing operation amount Ps in accordance with the control table.

The following describes one configuration example for calculating the rate of increase dQ of the target flow rate. In the present embodiment, the flow rate rate-of-increase calculation section 55 includes a reference rate-of-increase calculation section 61, a coefficient calculation section 62, and a multiplication section 63.

Figure 4:
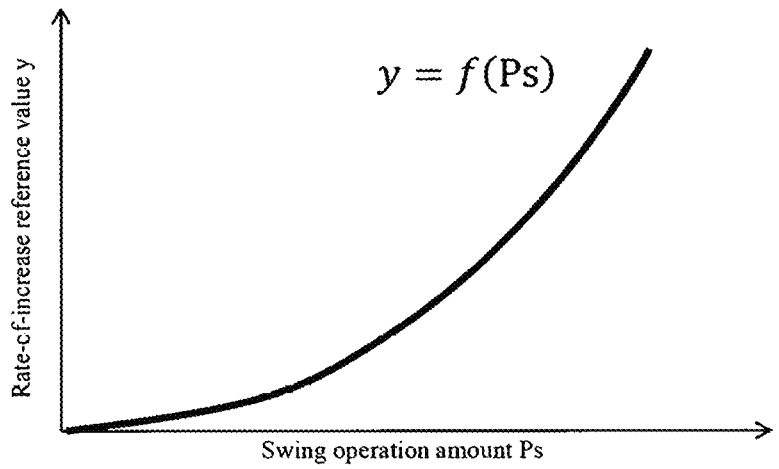
FIG. 4 is a diagram showing an exemplary control table loaded in a reference rate-of-increase calculation section included in the work machine according to the first embodiment of the present invention.

The reference rate-of-increase calculation section 61 is a processing section configured to calculate a reference value y of the rate of increase dQ on the basis of the swing operation amount Ps detected by the operation amount sensor 41 or 42 in accordance with the control table that defines an established relation (see FIG. 4). FIG. 4 illustrates a relation in which the reference value y of the rate of increase dQ increases with an increase of the swing operation amount Ps; specifically, the reference value y increases from 0 monotonously with an increase of the swing operation amount Ps from 0. The reference value y, while being defined with a curve in FIG. 4, may be defined with a straight line including a polygonal line.

Figure 5:
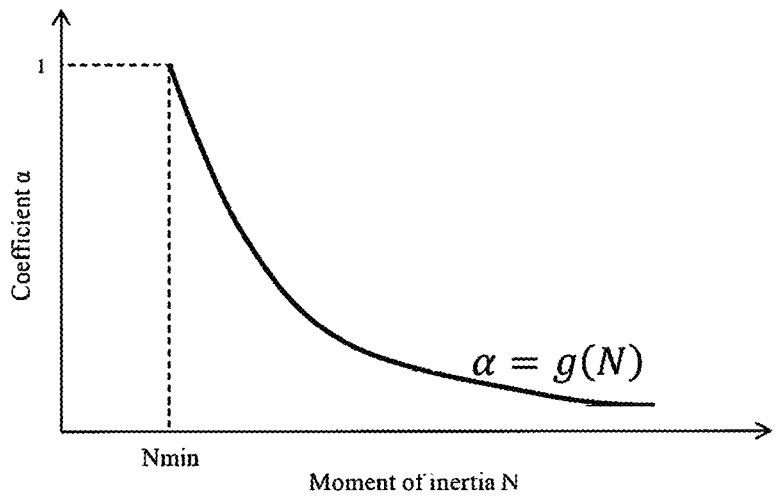
FIG. 5 is a diagram showing an exemplary control table loaded in a coefficient calculation section included in the work machine according to the first embodiment of the present invention.

The coefficient calculation section 62 is a processing section configured to calculate a coefficient α on the basis of the moment of inertia N calculated by the moment-of-inertia calculation section 54 in accordance with the control table that defines an established relation (see FIG. 5). FIG. 5 illustrates a relation in which the value of the coefficient α decreases with an increase of the moment of inertia N; specifically, the coefficient α is a maximum (=1) when the moment of inertia N is a minimum Nmin and decreases monotonously with an increase of the moment of inertia N. The coefficient α, while being defined with a curve in FIG. 5, may be defined with a straight line including a polygonal line. It is noted that the minimum moment of inertia Nmin represents a value when the work implement 3 is in an embraced posture (posture taken by the work implement 3 with a minimum turning radius) with an empty load condition (the bucket 13 not loaded with any load including sand).

The multiplication section 63 is a processing section configured to calculate the rate of increase dQ by multiplying the reference value y calculated by the reference rate-of-increase calculation section 61 by the coefficient α calculated by the coefficient calculation section 62. Specifically, the flow rate rate-of-increase calculation section 55 calculates the rate of increase dQ of the target flow rate Q'(t) by multiplying the reference value y corresponding to the swing operation amount Ps by the coefficient α corresponding to the moment of inertia N. The calculated rate of increase dQ increases with an increase of the swing operation amount Ps and decreases with a decrease of the moment of inertia N.

Command Flow Rate Calculation Section

The command flow rate calculation section 56 is a processing section configured to calculate the command flow rate Q(t) on the basis of the rate of increase dQ calculated by the flow rate rate-of-increase calculation section 55 with the target maximum flow rate Qmax calculated by the target maximum flow rate calculation section 53 set as an upper limit (target). The command flow rate calculation section 56 includes two processing sections of a target flow rate calculation section 64 and a minimum value selection section 65.

The target flow rate calculation section 64 is configured to calculate the target flow rate Q'(t) by adding up the rate of increase dQ for a duration time of a swing operation since the start of the swing operation with a standby flow rate of the hydraulic pump 22 as an initial value. Specifically, the target flow rate Q'(t) increases as the rate of increase dQ calculated for each processing cycle is added, for each cycle, to the delivery flow rate at the start of the swing operation (standby flow rate). The standby flow rate represents the delivery flow rate of the hydraulic pump 22 while no operation is performed, and the delivery flow rate when pump capacity is regulated to a minimum (or set capacity) by the regulator 24.

The minimum value selection section 65 is configured to select either the target flow rate Q'(t) calculated by the target flow rate calculation section 64 or the target maximum flow rate Qmax calculated by the target maximum flow rate calculation section 53, whichever is smaller, and output the selected value as the command flow rate Q(t). The command flow rate Q(t) increases by the rate of increase dQ for each cycle until the target maximum flow rate Qmax is reached while the operation amount of the operation device 34 falls within a predetermined condition (Q(t)=Q'(t)) and, after the target maximum flow rate Qmax is reached, remains constant (Q(t)=Qmax).

Output Section

The output section 57 is configured to generate a command signal Sf (current signal) corresponding to the command flow rate Q(t) calculated by the command flow rate calculation section 56 and outputs the command signal Sf to the regulator 24 (solenoid valve 48). The command signal Sf energizes a solenoid of the solenoid valve 48, so that the regulator 24 is activated to control the delivery flow rate of the hydraulic pump 22 to the command flow rate Q(t).

(1-3) Operation

Figure 6:
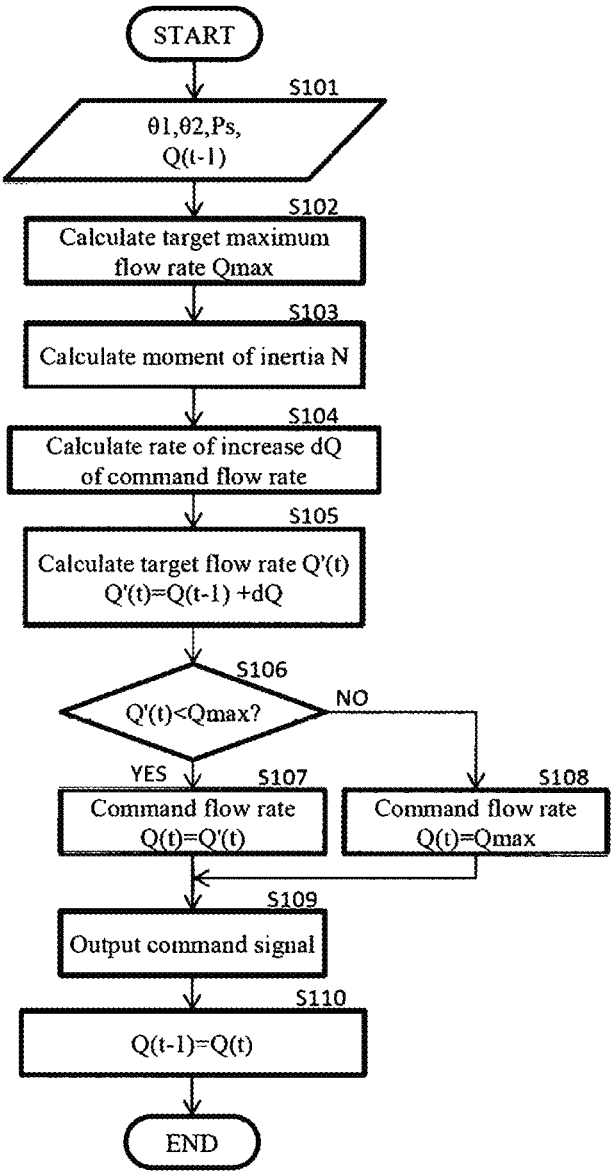
FIG. 6 is a flowchart of a pump delivery flow rate control process performed by the pump controller included in the work machine according to the first embodiment of the present invention.

FIG. 6 is a flowchart of a pump delivery flow rate control process performed by the pump controller according to the present embodiment. The control process shown in FIG. 6 is repeatedly performed by the pump controller 47 at predetermined cycles (e.g., 0.1 seconds) while the swing operation amount Ps is being input.

Start and Step S101

The operation lever of the operation device 34 is operated and the swing operation amount Ps is applied to the input section 51. This triggers the pump controller 47 and the process shown in FIG. 6 is started. In Step S101, the pump controller 47 causes the input section 51 to receive inputs of the swing operation amount Ps detected by the operation amount sensor 41 or 42, the angles θ1 and θ2 detected by the angle sensors 43 and 44, and the pressure P1 and P2 detected by the pressure sensors 45 and 46. Additionally, the pump controller 47 reads a command flow rate Q(t−1) of a preceding processing cycle from the storage section 52 via the input section 51. Q(t−1) when t=1 (first processing cycle) is the standby flow rate of the hydraulic pump 22.

Steps S102 and S103

In Step S102, the pump controller 47 causes the target maximum flow rate calculation section 53 to determine the target maximum flow rate Qmax corresponding to the swing operation amount Ps in accordance with the control table read from the storage section 52. The pump controller 47 also causes the moment-of-inertia calculation section 54 to calculate the moment of inertia N of the rotating body using the angles θ1 and θ2 and the pressure P1 and P2. Step S102 and Step S103 may be performed in reverse or in parallel.

Step S104

In Step S104, the pump controller 47 causes the flow rate rate-of-increase calculation section 55 calculates the rate of increase dQ of the command flow rate using values of the swing operation amount Ps and the moment of inertia N. In this case, the reference rate-of-increase calculation section 61 calculates the reference value y of the rate of increase of the command flow rate from the value of the swing operation amount Ps input in Step S101 (y=f(Ps); see FIG. 4).

Additionally, the coefficient calculation section 62 calculates the coefficient α of the rate of increase of the command flow rate from the value of the moment of inertia N obtained in Step S103 (α=g(N); see FIG. 5). Then, the multiplication section 63 multiplies the reference value y calculated by the reference rate-of-increase calculation section 61 by the coefficient α calculated by the coefficient calculation section 62 to thereby find the rate of increase dQ of the command flow rate (dQ=α×y).

Steps S105 to S108

In Step S105, the pump controller 47 causes the target flow rate calculation section 64 to add to the command flow rate Q(t−1) of the preceding cycle read in Step S101 the rate of increase dQ calculated in Step S104, to thereby calculate the target flow rate Q'(t). In subsequent Steps S106 to S108, the pump controller 47 causes the minimum value selection section 65 to compare the target maximum flow rate Qmax calculated in Step S102 with the target flow rate Q'(t) calculated in Step S105, selects a value whichever is smaller, and outputs the value as the command flow rate Q(t). Thus, in the present embodiment, the target flow rate Q'(t) is the command flow rate Q(t) to the extent below the target maximum flow rate Qmax and, after the target flow rate Q'(t) reaches the target maximum flow rate Qmax, the target maximum flow rate Qmax is the command flow rate Q(t).

Steps S109 to End

In Step S109, the pump controller 47 causes the output section 57 to generate a command signal Sf corresponding to the command flow rate Q(t) calculated by the command flow rate calculation section 56 and to output the command signal Sf to the solenoid valve 48. This results in the delivery flow rate of the hydraulic pump 22 being varied such that the command flow rate Q(t) is delivered. Finally, in Step S110, the pump controller 47 causes the storage section 52 to store the command flow rate Q(t) calculated in Step S107 or S108 as the command flow rate Q(t−1) to be read in Step S101 of the subsequent cycle, before terminating the process (for one cycle) of FIG. 6. Step S109 and Step S110 may be performed in reverse or in parallel.

The foregoing process is repeatedly performed as long as the swing operation amount Ps is being input. As a result, the flow rate of hydraulic fluid supplied from the hydraulic pump 22 to the swing motor 16 increases up to the target maximum flow rate Qmax as the upper limit at the rate of increase dQ corresponding to the swing operation amount Ps and the moment of inertia N.

(1-4) Effects

Achieving Both Energy Efficiency and Operability

The rate of increase dQ of the target flow rate decreases with greater moments of inertia N of the rotating body. Thus, in the beginnings of a swing operation involving a large moment of inertia of the rotating body, for example, the delivery flow rate of the hydraulic pump 22 with respect to a demanded flow rate for the swing motor 16 can be prevented from increasing excessively. Pressure in the delivery line of the hydraulic pump 22 can thus be prevented from increasing and discharge of hydraulic fluid via the relief valve can be reduced, so that energy efficiency (fuel consumption) can be improved through reduction of flow rate loss.

The rate of increase dQ of the target flow rate is varied also by the swing operation amount Ps, not dependent only on the moment of inertia N. Specifically, the rate of increase dQ increases with an increase of the swing operation amount Ps. Consider a case in which the rate of increase dQ is established only with the moment of inertia N. Then, when the lever is operated minimally in order to achieve a slow and careful swing operation when, for example, the moment of inertia of the swing structure is small, the delivery flow rate increases regardless of the operation amount, so that the swing angular acceleration increases against the intention of the operator. In the present embodiment, in contrast, the reference value y decreases with a decreasing swing operation amount Ps, so that the rate of increase dQ decreases with the swing operation amount Ps, though the coefficient $\alpha$ increases or decreases depending on the moment of inertia N. Thus, because the rate of increase dQ of the delivery flow rate corresponds to the swing operation amount Ps, favorable operability can be obtained.

As such, in accordance with the present embodiment, the energy efficiency and operability can both be achieved with respect to the swing operation by varying the rate of increase dQ in the delivery flow rate of the pump acting on the swing operation according to the moment of inertia N and the swing operation amount Ps.

Further Improvement on Energy Efficiency

As described previously, the directional control valve 31, for example, is an open center type having a center bypass passage. Use of this type of directional control valve has an advantage of operability that is different from a closed center type directional control valve. In a configuration including the open center type directional control valve used for the swing motor, the swing angular acceleration with respect to the swing operation amount depends on an opening area of the center bypass passage. The flow rate passing through the center bypass passage is, however, loss. Narrowing the center bypass passage in order to reduce the flow rate loss increases the swing angular acceleration due to an increase in the flow rate supplied to the swing motor even with an identical swing operation amount. Then, the increase in the swing speed becomes greater relative to the swing operation amount. This may result in degraded flexibility with respect to the swing operation.

The present embodiment appropriately determines the rate of increase dQ of the delivery flow rate corresponding to the moment of inertia N and the swing operation amount Ps through computational calculations. This can prevent an excessive increase in the delivery flow rate with respect to the swing operation amount Ps and in the swing angular acceleration even when the center bypass passage of the directional control valve 31 is narrowed. Thus, an effect of improved energy efficiency achieved by narrower center bypass passage can be enjoyed, while achieving flexible swing operability.

Second Embodiment (2-1) Configuration

Figure 7:
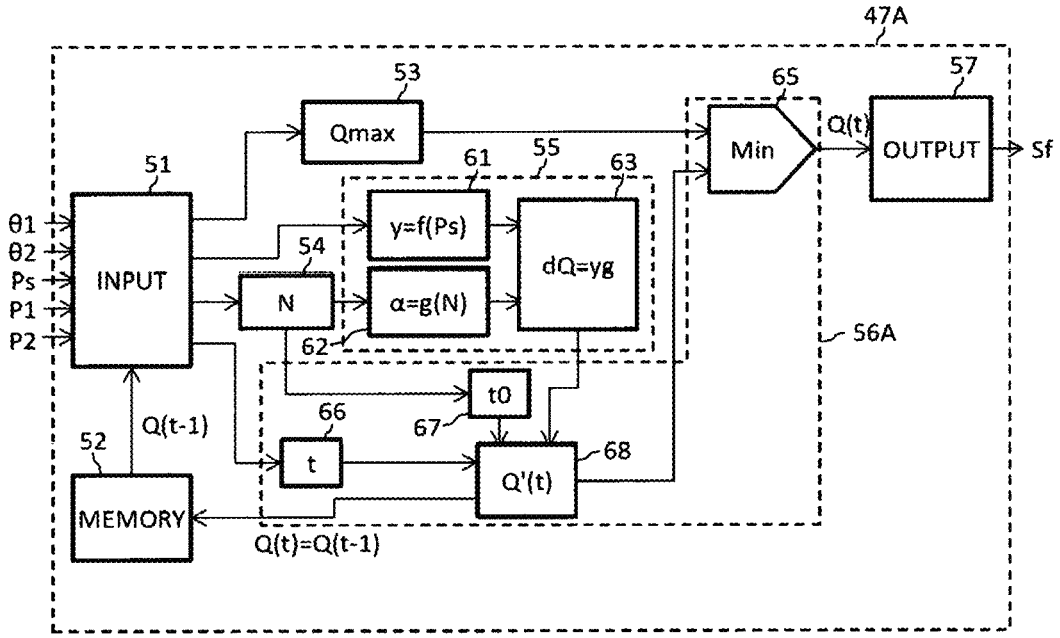
FIG. 7 is a schematic diagram of a pump controller included in a work machine according to a second embodiment of the present invention.

FIG. 7 is a schematic diagram of a pump controller according to a second embodiment of the present invention. In FIG. 7, like parts are identified by like reference numerals used for the first embodiment. A command flow rate calculation section 56A of a pump controller 47A according to the present embodiment differs from the command flow rate calculation section 56 of the pump controller 47 in the first embodiment. Because this is the only difference in configuration of the present embodiment from the first embodiment, the following describes only the command flow rate calculation section 56A and omits describing other configurations.

Command Flow Rate Calculation Section

The command flow rate calculation section 56A in the present embodiment includes an operation time calculation section 66, a delay time calculation section 67, a target flow rate calculation section 68, and the minimum value selection section 65.

The operation time calculation section 66 is a processing section configured to calculate a duration time t of a swing operation. The operation time calculation section 66 is, for example, a timer or a counter. The operation time calculation section 66 starts measuring time upon receipt of an input of a value of given magnitude or greater of the swing operation amount Ps and continues measuring time as long as the value of the given magnitude or greater of the swing operation amount Ps is continuously input.

The delay time calculation section 67 is a processing section configured to calculate delay time t0 with which timing to increase the command flow rate Q(t) (target flow rate Q'(t)) is delayed on the basis of the moment of inertia N calculated by the moment-of-inertia calculation section 54. In the present embodiment, the storage section 52 stores a control table that defines a relation between the moment of inertia N and the delay time t0. The delay time calculation section 67 loads the applicable control table from the storage section 52 and calculates the delay time t0 corresponding to the moment of inertia N in accordance with the control table.

When the duration time t of a swing operation calculated by the operation time calculation section 66 reaches the delay time t0 calculated by the delay time calculation section 67, the target flow rate calculation section 68 calculates the target flow rate Q'(t) by adding up the rate of increase dQ for the command flow rate with a standby flow rate of the hydraulic pump 22 as an initial value. The target flow rate calculation section 68 performs a function identical to the function performed by the target flow rate calculation section 64 of the first embodiment except that the rate of increase dQ is not added up until the delay time t0 is reached (specifically, the rate of increase dQ calculated before the lapse of the delay time t0 is ignored).

The minimum value selection section 65 performs a function substantially similar to the function performed in the first embodiment and the minimum value selection section 65 selects either the target flow rate Q'(t) calculated by the target flow rate calculation section 68 or the target maximum flow rate Qmax calculated by the target maximum flow rate calculation section 53, whichever is smaller, and outputs the selected value as the command flow rate Q(t).

(2-2) Operation

Figure 8:
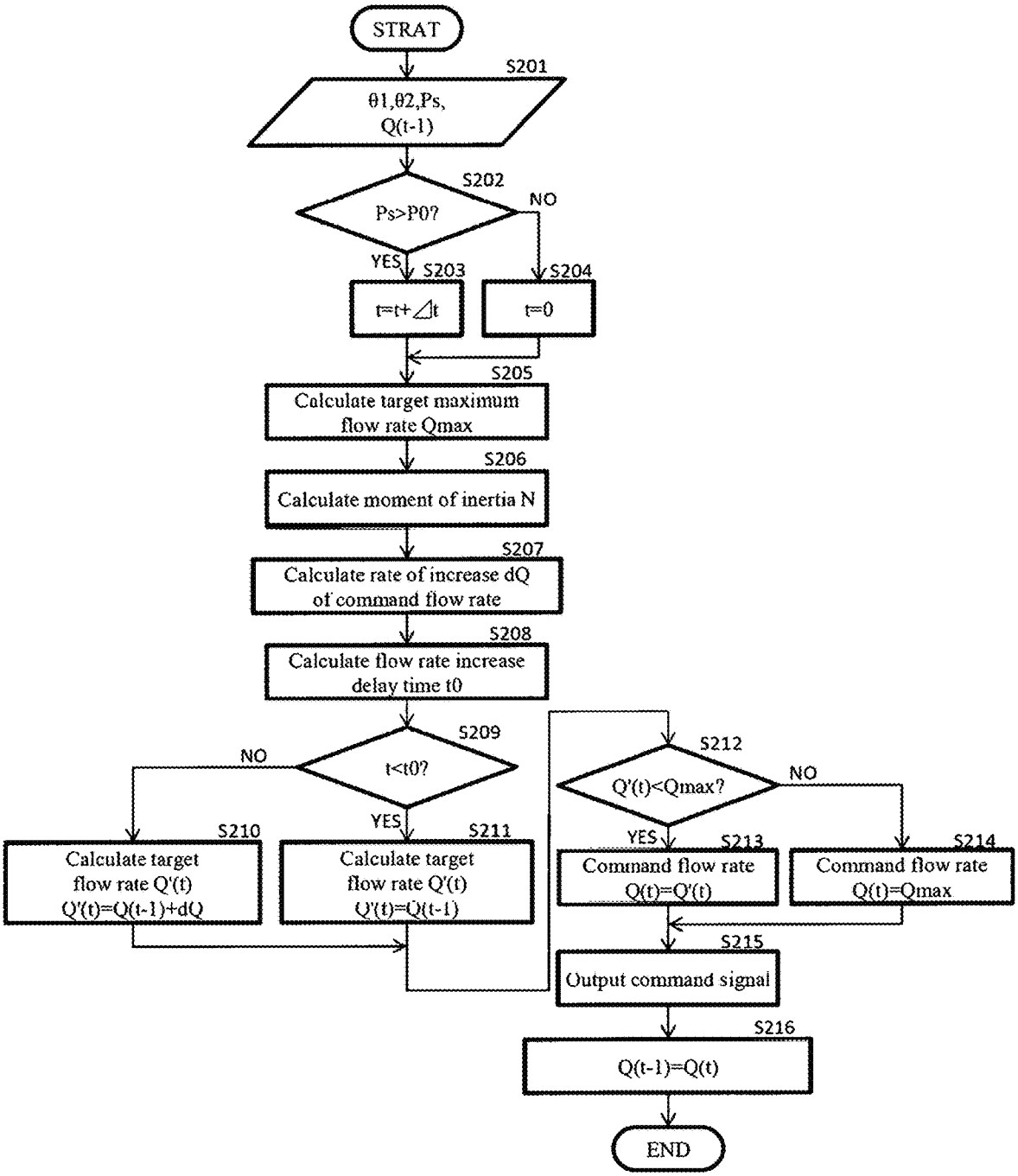
FIG. 8 is a flowchart of a pump delivery flow rate control process performed by the pump controller included in the work machine according to the second embodiment of the present invention.

FIG. 8 is a flowchart of a pump delivery flow rate control process performed by the pump controller according to the present embodiment. As in the first embodiment, the control process shown in FIG. 8 is repeatedly performed by the pump controller 47A at predetermined cycles (e.g., 0.1 seconds) while the swing operation amount Ps is being input.

Start to Step S208

Start and a step performed in Step S201 are identical to Start and the step performed in Step S101 described with reference to FIG. 6. Then, the pump controller 47A causes the operation time calculation section 66 to determine whether the swing operation amount Ps is greater than a threshold P0 established in advance (Step S202) and to calculate the duration time t of a swing operation. The operation time calculation section 66, if determining that the swing operation amount Ps is greater than the threshold P0, adds cycle time (Δt) to the duration time t of a swing operation (Step S203) and, if determining that the swing operation amount Ps is equal to or smaller than the threshold P0, maintains the duration time t at that particular timing (Step S204). The threshold P0 is a value for determining whether the swing operation is intentional. The initial value of the duration time t is 0. Steps of subsequent Steps S205 to S207 are the same as the steps of Steps S102 to S104 described with reference to FIG. 6.

Step S208 to End

Then, the pump controller 47A causes the delay time calculation section 67 to determine the delay time t0 corresponding to the moment of inertia N in accordance with the control table loaded from the storage section 52 (Step S208). The pump controller 47A causes the target flow rate calculation section 68 to compare the duration time t of a swing operation with the delay time and to determine whether the delay time t0 has elapsed since the start of the swing operation (Step S209). The target flow rate calculation section 68, if determining that the delay time t0 has elapsed since the start of the swing operation (t t0), adds the rate of increase dQ calculated in Step S207 to the command flow rate Q(t−1) of the preceding cycle to thereby increase and output the target flow rate Q'(t) (Step S210). If determining that the delay time t0 is yet to elapse since the start of the swing operation (t<t0), the target flow rate calculation section 68 directly outputs the command flow rate Q(t−1) of the preceding cycle as the target flow rate Q'(t) without adding the rate of increase dQ calculated in Step S207 (Step S211). Steps of subsequent Steps S212 to End are the same as the steps of Steps S106 and subsequent steps described with reference to FIG. 6.

The foregoing process is repeatedly performed as long as the swing operation amount Ps is being input and, after the lapse of the delay time t0, the delivery flow rate of hydraulic fluid from the hydraulic pump 22 increases up to the target maximum flow rate Qmax as the upper limit at the rate of increase dQ corresponding to, for example, the swing operation amount Ps.

(2-3) Effects

In the present embodiment, too, the delivery flow rate of the hydraulic pump 22 increases at the rate of increase dQ determined according to the swing operation amount Ps and the moment of inertia N, so that the effects similar to the effects achieved by the first embodiment can be achieved.

The hydraulic pump 22 delivers a predetermined flow rate (standby flow rate) even when the operation device 34 is not operated as long as the engine 21 is running. This contributes to guarantee of leak flow rate of the hydraulic circuit and secured responsiveness of delivery flow rate control. The hydraulic pump 22 delivers the standby flow rate from the very beginning when the delivery flow rate from the hydraulic pump 22 is desirably increased at a gradual pace as the swing operation is started so as to respond to the demanded flow rate for the swing motor 16. As a result, the delivery flow rate from the hydraulic pump 22 tends to increase relative to the demanded flow rate for the swing motor 16 at the start of the swing operation. When the delivery flow rate from the hydraulic pump 22 is increased immediately after the start of the swing operation, the difference between the delivery flow rate and the demanded flow rate increases and the swing angular acceleration can be large with respect to the operation. In the present embodiment, therefore, the delay time t0 is introduced after the start of the swing operation before the delivery flow rate from the hydraulic pump 22 is increased. This reduces the difference between the demanded flow rate for the swing motor 16 and the delivery flow rate from the hydraulic pump 22 to thereby improve validity of the swing angular acceleration control.

Third Embodiment (3-1) Configuration

Figure 9:
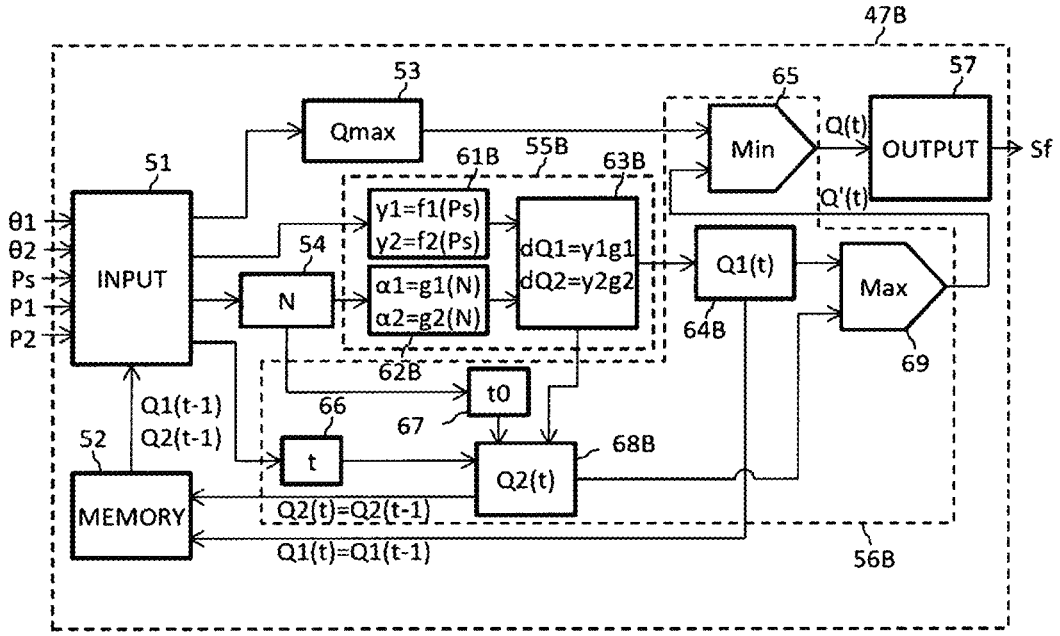
FIG. 9 is a schematic diagram of a pump controller included in a work machine according to a third embodiment of the present invention.

FIG. 9 is a schematic diagram of a pump controller according to a third embodiment of the present invention. In FIG. 9, like parts are identified by like reference numerals used for the first and second embodiments. In the present embodiment, a flow rate rate-of-increase calculation section 55B and a command flow rate calculation section 56B of a pump controller 47B differ from the flow rate rate-of-increase calculation section 55 and the command flow rate calculation section 56 of the pump controller 47 in the first embodiment. Because this is the only difference in configuration of the present embodiment from the first embodiment, the following describes only the flow rate rate-of-increase calculation section 55B and the command flow rate calculation section 56B and omits describing other configurations.

Flow Rate Rate-of-Increase Calculation Section

The flow rate rate-of-increase calculation section 55B in the present embodiment differs from the flow rate rate-of-increase calculation section 55 of the first embodiment in that the flow rate rate-of-increase calculation section 55B calculates two rates of increase of a first rate of increase dQ1 and a second rate of increase dQ2. The first rate of increase dQ1 and the second rate of increase dQ2 have a relation with respect to the moment of inertia N and the swing operation amount Ps such that, as defined in advance, the first rate of increase dQ1 has a value smaller than a value of the second rate of increase dQ2 and a control table that defines the relation is stored in the storage section 52. For example, the flow rate rate-of-increase calculation section 55B includes a reference rate-of-increase calculation section 61B, a coefficient calculation section 62B, and a multiplication section 63B.

Figure 10:
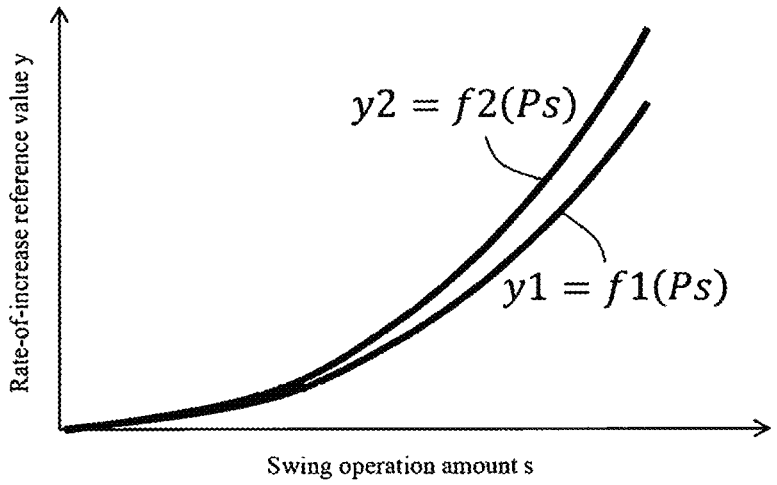
FIG. 10 is a diagram showing an exemplary control table loaded in a reference rate-of-increase calculation section included in the work machine according to the third embodiment of the present invention.

The reference rate-of-increase calculation section 61B is a processing section configured to calculate, in accordance with a control table that defines a predetermined relation (see FIG. 10), a reference value y1 of the first rate of increase dQ1 and a reference value y2 of the second rate of increase dQ2 on the basis of the swing operation amount Ps detected by the operation amount sensor 41 or 42. FIG. 10 illustrates a relation in which each of the reference values y1 and y2 increases from 0 as the swing operation amount Ps increases from 0. The control table defines that y1<y2 for an identical swing operation amount Ps. The reference value y2 may be made equal to, for example, the reference value y shown in FIG. 4. Each of the reference values y1 and y2, while being defined with a curve in FIG. 10, may be defined with a straight line including a polygonal line.

Figure 11:
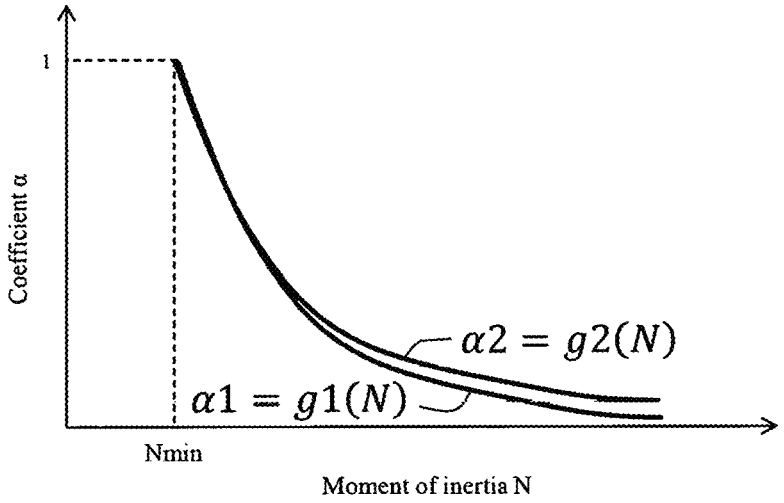
FIG. 11 is a diagram showing an exemplary control table loaded in a coefficient calculation section included in the work machine according to the third embodiment of the present invention.

The coefficient calculation section 62B is a processing section configured to calculate, in accordance with a control table that defines a predetermined relation (see FIG. 11), a first coefficient α1 and a second coefficient α2 on the basis of the moment of inertia N calculated by the moment-of-inertia calculation section 54. FIG. 11 illustrates a relation in which both values of the first coefficient α1 and the second coefficient α2 decrease with an increase of the moment of inertia N. In the present embodiment, the first coefficient α1 and the second coefficient α2 both monotonously increase with an increasing moment of inertia N with the first coefficient α1 and the second coefficient α2 at a minimum moment of inertia Nmin the greatest (=1). The control table defines that α1<α2 for an identical moment of inertia N. Each of the first coefficient α1 and the second coefficient α2, while being defined with a curve in FIG. 11, may be defined with a straight line including a polygonal line.

The multiplication section 63B is a processing section configured to calculate the first rate of increase dQ1 by multiplying the reference value y1 by the first coefficient α1 and calculates the second rate of increase dQ2 by multiplying the reference value y2 by the second coefficient α2. The first rate of increase dQ1 is calculated to be smaller than the second rate of increase dQ2. It is noted that not both of the conditions of y1<y2 and α1<α2 are necessarily required. For example, a condition may cause a difference to occur only in the reference value, such as y1<y2 and α1=α2, or a condition may cause a difference to occur only in the coefficient, such as y1=y2 and α1<α2.

Command Flow Rate Calculation Section

The command flow rate calculation section 56B is a processing section that increases the command flow rate Q(t) at the first rate of increase dQ1 or the second rate of increase dQ2 calculated by the flow rate rate-of-increase calculation section 55B up to the target maximum flow rate Qmax calculated by the target maximum flow rate calculation section 53 as a target (upper limit). The command flow rate calculation section 56B includes a first flow rate calculation section 64B, the operation time calculation section 66, the delay time calculation section 67, a second flow rate calculation section 68B, a maximum value selection section 69, and the minimum value selection section 65. Of the foregoing sections, the operation time calculation section 66 and the delay time calculation section 67 are the same as those described with reference to the second embodiment.

The first flow rate calculation section 64B is a processing section configured to calculate a first flow rate Q1(*t*) by adding the first rate of increase dQ1 since the start of the swing operation with the standby flow rate of the hydraulic pump 22 as an initial value. The first flow rate calculation section 64B functions similarly to the target flow rate calculation section 64 in the first embodiment except that the rate of increase to be added is the first rate of increase dQ1.

The second flow rate calculation section 68B is a processing section configured to calculate a second flow rate Q2(*t*) by adding the second rate of increase dQ2 after the duration time t of a swing operation reaches the delay time t0 with the standby flow rate of the hydraulic pump 22 as an initial value. The second flow rate calculation section 68B functions similarly to the target flow rate calculation section 68 in the second embodiment except that the rate of increase to be added is the second rate of increase dQ2.

The maximum value selection section 69 is a processing section configured to select either the first flow rate Q1(*t*) or the second flow rate Q2(*t*), whichever is greater, and outputs the selected value as a target flow rate Q'(t). Because the second flow rate Q2(*t*) remains taking an initial value until the delay time to is reached, the first flow rate Q1(*t*) is greater than the second flow rate Q2(*t*) for some time after the start of the swing operation; however, the first rate of increase dQ1 is smaller than the second rate of increase dQ2, so that the second flow rate Q2(*t*) is eventually greater than the first flow rate Q1(*t*) when the swing operation is continuously performed. Thus, the first flow rate Q1(*t*) is output as the target flow rate Q'(t) for some time after the start of the swing operation and the second flow rate Q2(*t*) is thereafter output as the target flow rate Q'(t).

The minimum value selection section 65 functions similarly to the minimum value selection sections 65 in the first and second embodiments and selects either the target flow rate Q'(t) output from the maximum value selection section 69 or a target maximum flow rate Qmax calculated by the target maximum flow rate calculation section 53, whichever is smaller, and outputs the selected value as the command flow rate Q(t).

(3-2) Operation

Figure 12:
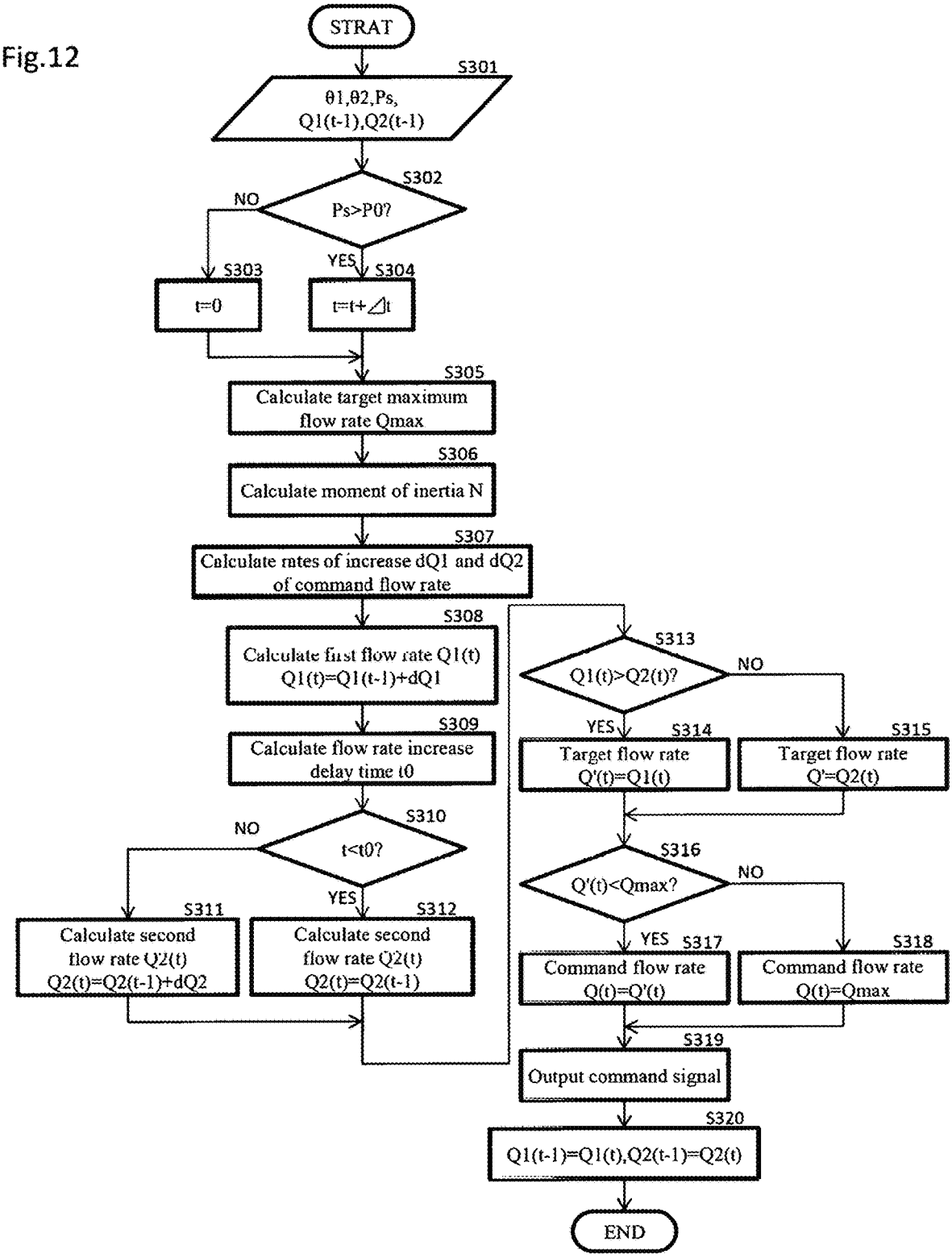
FIG. 12 is a flowchart of a pump delivery flow rate control process performed by the pump controller included in the work machine according to the third embodiment of the present invention.

FIG. 12 is a flowchart of a pump delivery flow rate control process performed by the pump controller according to the present embodiment. As in the first and second embodiments, the control process shown in FIG. 12 is repeatedly performed by the pump controller 47B at predetermined cycles (e.g., 0.1 seconds) while the swing operation amount Ps is being input.

Start to S307

Start and steps performed up to Step S306 are identical to Start and the steps performed up to Step S206 described with reference to FIG. 8. It is, however, noted that, in Step S301, a first flow rate Q1(*t*−1) and a second flow rate Q2(*t*−1) of a preceding cycle, instead of the command flow rate Q(t−1) of the preceding cycle, are read. In Step S307, the pump controller 47B causes the flow rate rate-of-increase calculation section 55B to calculate the first rate of increase dQ1 and the second rate of increase dQ2 as described previously.

Step S308

In Step S308, the pump controller 47B causes the first flow rate calculation section 64B to add the first rate of increase dQ1 calculated in Step S307 to the first flow rate Q1(*t*−1) of the preceding cycle read in Step S301 to thereby calculate the first flow rate Q1(*t*), the same step performed in Step S105 of FIG. 6.

Steps S309 to S312

Then, the pump controller 47B fixes the delay time t0 (Step S309) and determines whether the delay time t0 has elapsed since the start of the swing operation (Step S310). If it is determined that the delay time t0 has elapsed since the start of the swing operation (t≥t0), the second rate of increase dQ2 calculated in Step S307 is added to the second flow rate Q2(*t*−1) of the preceding cycle to thereby increase and output the second flow rate Q2(*t*) (Step S311). If it is determined that the delay time t0 is yet to elapse since the start of the swing operation (t<t0), the second rate of increase dQ2 is not added and the second flow rate Q2(*t*−1) of the preceding cycle is, as is, directly output as the second flow rate Q2(*t*) (Step S312). Steps of Steps S309 to S312 are the same as the steps of Steps S208 to S211 described with reference to FIG. 8.

Steps S313 to S315

In Step S313, the pump controller 47B causes the maximum value selection section 69 to compare the first flow rate Q1($t$) calculated in Step S308 with the second flow rate Q2($t$) calculated in Step S311 or S312. A value, whichever is greater, is selected and output as the target flow rate Q'(t) (Step S314 or S315).

Step S316 to End

The pump controller 47B then causes the minimum value selection section 65 to compare the target maximum flow rate Qmax calculated in Step S305 with the target flow rate Q'(t) calculated in Step S314 or S315 (Step S316). The minimum value selection section 65 thereby selects a value, whichever is smaller, and outputs the selected valve as the command flow rate Q(t) (Step S317 or S318). Thus, in the present embodiment, the target flow rate Q'(t) is the command flow rate Q(t) to the extent below the target maximum flow rate Qmax. Step S319 and subsequent steps are the same as Steps S215 and the subsequent steps described with reference to FIG. 8. It should, however, be noted that, in Step S320, the storage section 52 stores the first flow rate Q1($t$) calculated in Step S308 as Q1($t$−1) to be read in the subsequent cycle and the second flow rate Q2($t$) calculated in Step S311 or S312 as Q2($t$−1).

The foregoing process is repeatedly performed as long as the swing operation amount Ps is being input. As a result, the delivery flow rate of the hydraulic pump 22 increases up to the target maximum flow rate Qmax as the upper limit so as to correspond to the swing operation amount Ps and the moment of inertia N.

(3-3) Effects

In the present embodiment, too, the command flow rate Q(t) increases at the rate of increase dQ1 or dQ2 determined according to the swing operation amount Ps and the moment of inertia N, so that the effects similar to the effects achieved by the first embodiment can be achieved.

Figure 13:
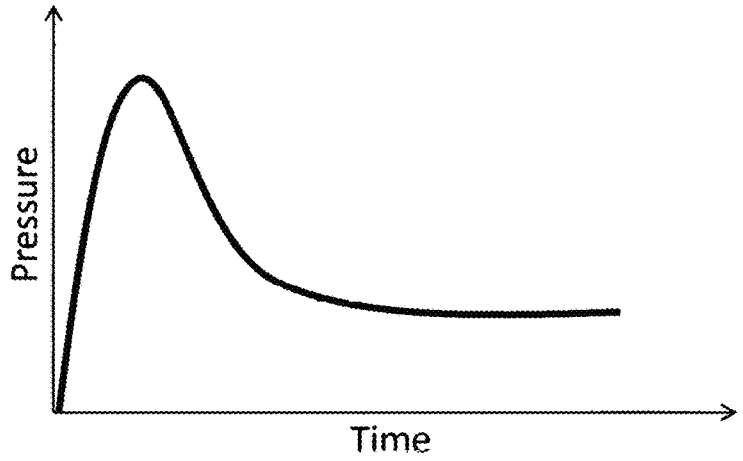
FIG. 13 is a graph showing changes with time in pump delivery pressure during a swing operation.

FIG. 13 is a graph showing changes with time in the pump delivery pressure during a swing operation. When the supply of hydraulic fluid to the swing motor is started, the pump delivery pressure typically rises to a peak value before thereafter converging to a steady value as shown in FIG. 13. When the rate of increase of the pump delivery flow rate is to be controlled at this time, the target flow rate Q'(t) may increase, not monotonously, but pulsatingly depending on the situation. In this case, the delivery flow rate is slower to increase, resulting in a delay in the rise of the swing angular velocity, compared with a case in which the rate of increase is not controlled. In the second embodiment, timing at which the delivery flow rate is increased is retarded in order to prevent the swing acceleration from increasing excessively; however, the standby flow rate, when kept as is, may cause the pump delivery pressure to be in short supply and the rise of the swing angular acceleration may be delayed relative to the swing operation depending on conditions. In the present embodiment, though the second flow rate Q2($t$) as the final target flow rate is not active until the delay time t0 is reached, the first flow rate Q1($t$) is active during that time to achieve an increase at a lower rate of increase. Thus, the command flow rate Q(t) increases at the lower rate of increase even before the delay time t0 elapses. Thus, the hydraulic pump 22 delivers a flow rat sufficient to guarantee the pump delivery pressure, so that the rise in the swing angular velocity of the swing motor 16 can be prevented from being delayed.

Modification

Variations of State Quantity Sensors

Figure 14:
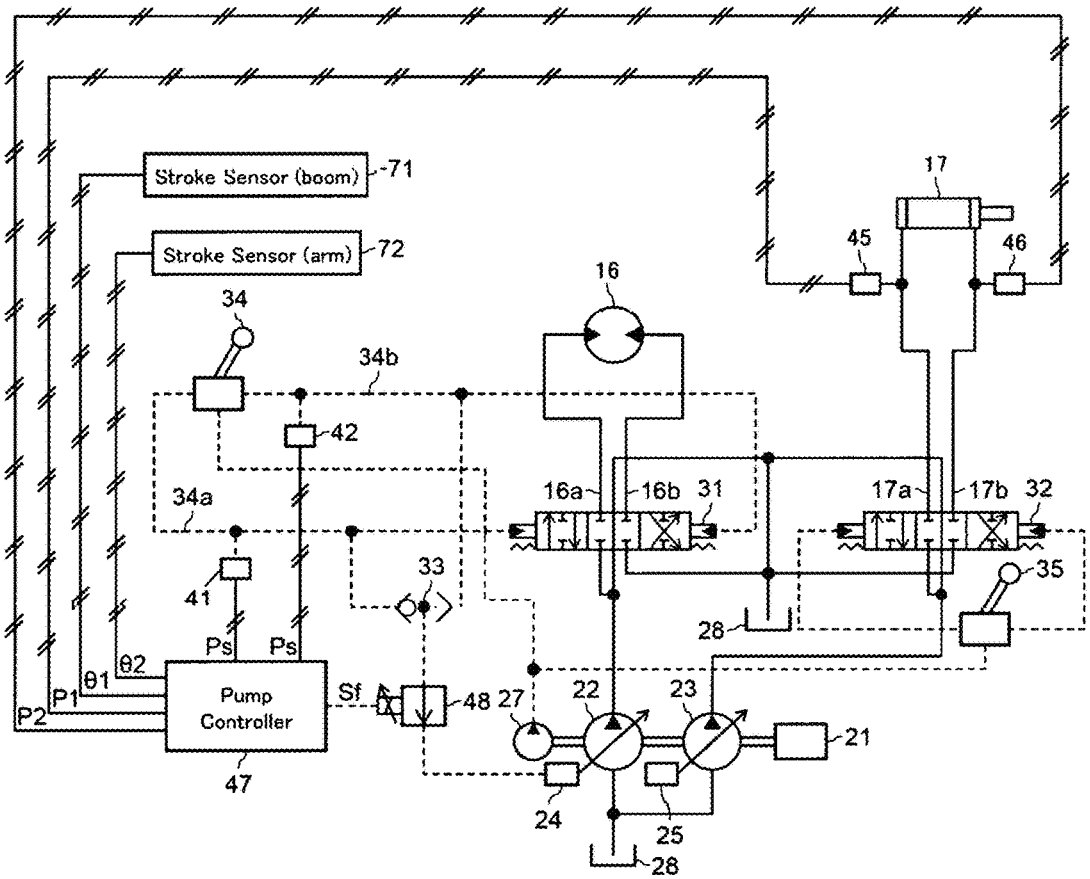
FIG. 14 is a circuit diagram showing major components of a hydraulic system included in a work machine according to a modification of the present invention.

FIG. 14 is a circuit diagram showing major components of a hydraulic system included in the work machine according to a modification of the present invention. In FIG. 14, like parts are identified by like reference numerals used for the first to third embodiments. In each of the embodiments described above, the angle sensors 43 and 44 have been illustrated as the state quantity sensors for acquiring basic information for calculating the posture of the work implement 3. The angle sensors 43 and 44 as the state quantity sensors for acquiring the basic information for calculating the posture of the work implement 3 are, however, illustrative only and not limiting. As shown in FIG. 14, for example, a boom stroke sensor 71 configured to detect an extension amount of the boom cylinder 17 and an arm stroke sensor 72 configured to detect an extension amount of the arm cylinder 18 may be used in place of the angle sensors 43 and 44. The modification in other respects is configured in a similar manner as in the first embodiment, the second embodiment, or the third embodiment. The posture of the work implement 3 can be calculated also with the stroke amounts of the boom cylinder 17 and the arm cylinder 18 and a process similar to the process in the first embodiment, the second embodiment, or the third embodiment can be performed.

Miscellaneous

While the hydraulic pilot type operation device 34 has been exemplarily described above, an electric lever may still be used for the operation device 34. In this case, a potentiometer may be used for the operation amount sensor. A hydraulic signal to be applied to the directional control valve 31 may be generated by subjecting the delivery pressure from the pilot pump 27 as source pressure to pressure reduction by a proportional solenoid valve. Specifically, the proportional solenoid valve is driven by an operation signal of the electric lever or a command signal output from a controller in response to the operation signal and the directional control valve 31 is thereby driven. The present invention is also applicable to such a configuration.

The directional control valve 31, for example, may be a closed center valve, instead of having a center bypass passage. The present invention is applicable also to the foregoing configuration.

Additionally, while a configuration has been illustrated in which the hydraulic pump 22, for example, is driven by the engine 21 (internal combustion engine) as a prime mover, the present invention is still applicable to a work machine including an electric motor as a prime mover.

DESCRIPTION OF REFERENCE CHARACTERS

1: Track structure (base structure)
2: Swing structure
3: Work implement
11: Boom
12: Arm
16: Swing meter
17: Boom cylinder
18: Arm cylinder
22, 23: Hydraulic pump
24, 25: Regulator
31, 32: Directional control valve
34, 35: Operation device
41, 42: Operation amount sensor
43: Angle sensor (boom angle sensor, state quantity sensor)
44: Angle sensor (arm angle sensor, state quantity sensor)
45, 46: Pressure sensor (state quantity sensor)
53: Target maximum flow rate calculation section
54: Moment-of-inertia calculation section
55, 55B: Flow rate rate-of-increase calculation section
56, 56A, 56B: Command flow rate calculation section
57: Output section
61, 61B: Reference rate-of-increase calculation section

62, 62B: Coefficient calculation section
63, 63B: Multiplication section
64: Target flow rate calculation section
64B: First flow rate calculation section
65: Minimum value selection section
66: Operation time calculation section
67: Delay time calculation section
68: Target flow rate calculation section
68B: Second flow rate calculation section
69: Maximum value selection section
71: Boom stroke sensor (state quantity sensor)
72: Arm stroke sensor (state quantity sensor)
dQ: Rate of increase
P1, P2: Pressure
Ps: swing Operation amount
Qreq: Demanded flow rate
Q(t): Command flow rate
Q'(t): Integrated flow rate
Sf: Command signal
t: Duration time of swing operation
t0: Delay time
y: Reference value
α: Coefficient
θ1, θ2: Angle

The invention claimed is:

1. A work machine including a base structure, a swing structure disposed swingably on an upper portion of the base structure, a work implement disposed in the swing structure, a swing motor that drives the swing structure, a variable displacement type hydraulic pump that delivers hydraulic fluid for driving the swing motor, a regulator configured to regulate a delivery flow rate of the hydraulic pump, a directional control valve configured to control hydraulic fluid to be supplied from the hydraulic pump to the swing motor, and an operation device configured to generate an operation signal corresponding to an operation and drive the directional control valve, the work machine comprising:

an operation amount sensor configured to detect a swing operation amount as an operation amount of the operation device;

a plurality of state quantity sensors configured to detect state quantities serving as bases for calculation of a moment of inertia of the swing structure and the work implement;

a target maximum flow rate calculation section configured to calculate a target maximum flow rate of the hydraulic pump to correspond to the swing operation amount;

a moment-of-inertia calculation section configured to calculate the moment of inertia on a basis of the state quantities detected by the state quantity sensors;

a flow rate rate-of-increase calculation section configured to calculate, in accordance with a relation established in advance among the moment of inertia, the swing operation amount, and a rate of increase of a command flow rate with respect to the hydraulic pump, the rate of increase on a basis of the moment of inertia calculated by the moment-of-inertia calculation section and the swing operation amount detected by the operation amount sensor;

a command flow rate calculation section configured to calculate the command flow rate on a basis of the rate of increase calculated by the flow rate rate-of-increase calculation section with the target maximum flow rate calculated by the target maximum flow rate calculation section set as an upper limit; and an output section configured to output a command signal to the regulator corresponding to the command flow rate calculated by the command flow rate calculation section.

2. The work machine according to claim 1, wherein the flow rate rate-of-increase calculation section includes:

a reference rate-of-increase calculation section configured to calculate a reference value of the rate of increase on a basis of the swing operation amount detected by the operation amount sensor in accordance with an established relation in which a value of the reference value increases with an increase of the swing operation amount;

a coefficient calculation section configured to calculate a coefficient on a basis of the moment of inertia calculated by the moment-of-inertia calculation section in accordance with an established relation in which a value of the coefficient decreases with an increase of the moment of inertia; and a multiplication section configured to calculate the rate of increase by multiplying the reference value calculated by the reference rate-of-increase calculation section by the coefficient calculated by the coefficient calculation section.

3. The work machine according to claim 1, wherein the command flow rate calculation section includes:

a target flow rate calculation section configured to calculate a target flow rate by adding up the rate of increase since a start of a swing operation with a standby flow rate of the hydraulic pump as an initial value; and a minimum value selection section configured to select either a value of the target flow rate calculated by the target flow rate calculation section or a value of the target maximum flow rate calculated by the target maximum flow rate calculation section, whichever is smaller, and output the selected value as the command flow rate.

4. The work machine according to claim 1, wherein the command flow rate calculation section includes:

an operation time calculation section configured to calculate a duration time of a swing operation;

a delay time calculation section configured to calculate delay time with which timing to increase the command flow rate is delayed on a basis of the moment of inertia calculated by the moment-of-inertia calculation section;

a target flow rate calculation section configured to calculate a target flow rate by adding up the rate of increase after the duration time of a swing operation reaches the delay time with a standby flow rate of the hydraulic pump as an initial value; and a minimum value selection section configured to select either a value of the target flow rate calculated by the target flow rate calculation section or a value of the target maximum flow rate calculated by the target maximum flow rate calculation section, whichever is smaller, and output the selected value as the command flow rate.

5. The work machine according to claim 1, wherein the flow rate rate-of-increase calculation section calculates a first rate of increase and a second rate of increase that is greater in value than the first rate of increase, and the command flow rate calculation section includes:

a first flow rate calculation section configured to calculate a first flow rate by adding up the first rate of increase since a start of a swing operation with a standby flow rate of the hydraulic pump as an initial value;

an operation time calculation section configured to calculate a duration time of a swing operation;

a delay time calculation section configured to calculate delay time with which timing to increase the command flow rate is delayed on a basis of the moment of inertia calculated by the moment-of-inertia calculation section;

a second flow rate calculation section configured to calculate a second flow rate by adding up the second rate of increase after the duration time of a swing operation reaches the delay time with the standby flow rate of the hydraulic pump as an initial value;

a maximum value selection section configured to select either a value of the first flow rate or a value of the second flow rate, whichever is greater, and output the selected value as a target flow rate; and a minimum value selection section configured to select either a value of the target flow rate output from the maximum value selection section or a value of a target maximum flow rate calculated by the target maximum flow rate calculation section, whichever is smaller, and output the selected value as the command flow rate.

6. The work machine according to claim 1, wherein the work implement includes a boom, an arm coupled to the boom, a boom cylinder that drives the boom, and an arm cylinder that drives the arm, the state quantity sensors include a boom angle sensor configured to detect an angle formed between the swing structure and the boom, an arm angle sensor configured to detect an angle formed between the boom and the arm, and at least one pressure sensor configured to detect load pressure of the boom cylinder, and the moment-of-inertia calculation section calculates the moment of inertia on a basis of posture of the work implement obtained from values of the boom angle sensor and the arm angle sensor and weight of a load obtained from a value of the pressure sensor.

7. The work machine according to claim 1, wherein the work implement includes a boom, an arm coupled to the boom, a boom cylinder that drives the boom, and an arm cylinder that drives the arm, the state quantity sensors include a boom stroke sensor configured to detect an extension amount of the boom cylinder, an arm stroke sensor configured to detect an extension amount of the arm cylinder, and at least one pressure sensor configured to detect differential pressure across the boom cylinder, and the moment-of-inertia calculation section calculates the moment of inertia on a basis of posture of the work implement obtained from values of the boom stroke sensor and the arm stroke sensor and weight of a load obtained from a value of the pressure sensor.

* * * * *